US005116581A

United States Patent [19]

Cyron et al.

[11] Patent Number: 5,116,581

[45] Date of Patent: May 26, 1992

[54] MOUNTING ASSEMBLY FOR AN EXHAUST GAS CATALYST

[75] Inventors: Theodor Cyron; Wolfgang Maus, both of Bergisch Gladbach, Fed. Rep. of Germany

[73] Assignee: Interatom GmbH, Bergisch Gladbach, Fed. Rep. of Germany

[21] Appl. No.: 244,075

[22] Filed: Sep. 13, 1988

Related U.S. Application Data

[63] Continuation-in-part of Ser. No. 70,034, Jul. 6, 1987, Pat. No. 4,795,615, which is a continuation-in-part of Ser. No. 888,827, Jul. 22, 1986, abandoned.

[30] Foreign Application Priority Data

Jul. 25, 1985 [DE] Fed. Rep. of Germany ..... 3526681

[51] Int. Cl.[5] ..... B01J 8/02

[52] U.S. Cl. ..... 422/180; 422/181; 422/221; 422/222; 422/179; 181/256

[58] Field of Search ..... 422/179, 180, 181, 221, 422/222; 29/451, 157 R, 455.1; 181/256

[56] References Cited

U.S. PATENT DOCUMENTS

| | | | |
|---|---|---|---|
| 3,841,839 | 10/1974 | Wiley | 422/179 |
| 3,852,042 | 12/1974 | Wagner | 422/179 |
| 4,155,980 | 5/1979 | Santiago et al. | 422/179 |
| 4,163,041 | 7/1979 | Gaysert | 248/571 |
| 4,248,833 | 2/1981 | Aoyama | 422/179 |
| 4,264,561 | 4/1981 | Goedicke | 422/179 |
| 4,269,807 | 5/1981 | Bailey et al. | 422/179 |
| 4,278,639 | 7/1981 | Tadokoro et al. | 422/179 |
| 4,328,187 | 5/1982 | Musall et al. | 422/179 |
| 4,332,307 | 6/1982 | Ito | 181/256 |
| 4,344,921 | 8/1982 | Santiago et al. . | |
| 4,448,754 | 5/1984 | Isogai et al. | 422/179 |
| 4,629,605 | 12/1986 | Santiago | 422/179 |
| 4,795,615 | 1/1989 | Cyron et al. | 422/179 |
| 4,795,616 | 1/1989 | Mondt et al. | 422/179 |

*Primary Examiner*—David A. Simmons
*Assistant Examiner*—Thi Dang
*Attorney, Agent, or Firm*—Herbert L. Lerner; Laurence A. Greenberg

[57] ABSTRACT

A mounting assembly for an exhaust gas catalyst includes a metallic exhaust gas catalyst carrier body and a tubular jacket in which the catalyst carrier body is disposed. The catalyst carrier body is fastened to the tubular jacket while permitting lengthwise expansion of the catalyst carrier body, through the use of beads encircling at least part of the catalyst carrier body and corresponding formations formed in the tubular jacket into which the beads protrude in the form of slots and keys. The catalyst carrier body and the beads are disposed at axial and radial distances from the tubular jacket and the formations.

4 Claims, 1 Drawing Sheet

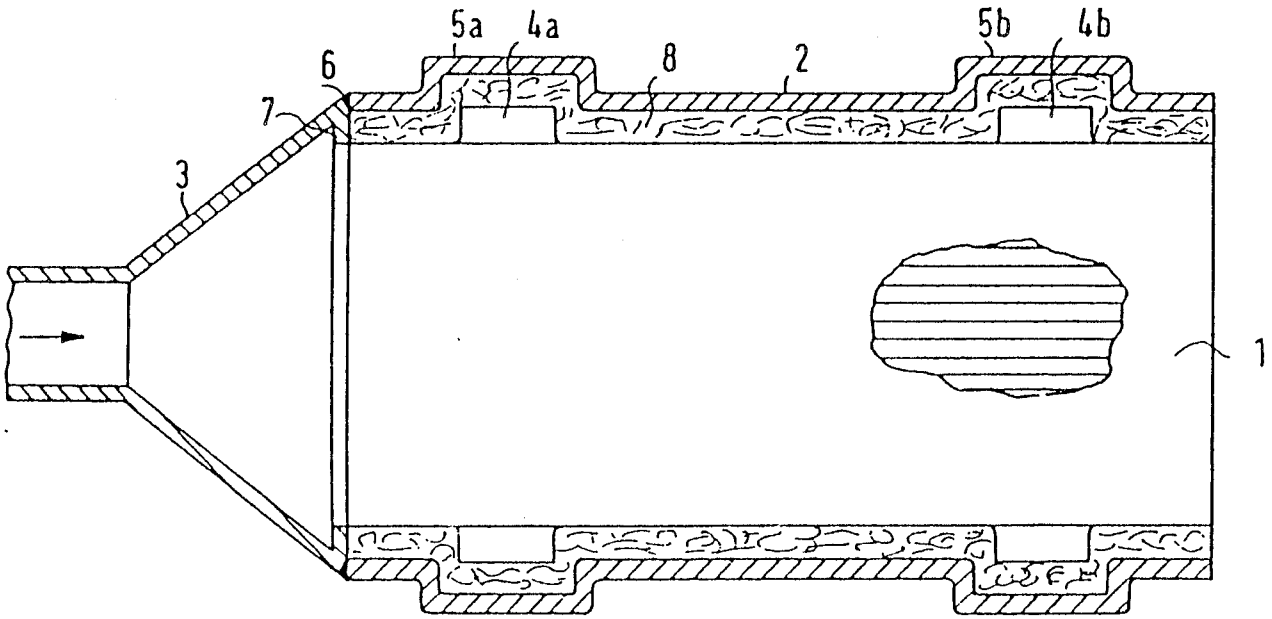
1
4b
5b
2
8
4a
5a
6
7
3

MOUNTING ASSEMBLY FOR AN EXHAUST GAS CATALYST

CROSS-REFERENCE TO RELATED APPLICATIONS

This application is a continuation-in-part of allowed application Ser. No. 070,034, filed Jul. 6, 1987, now U.S. Pat. No. 4,795,615, which is in turn a continuation-in-part of abandoned application Ser. No. 888,827, filed Jul. 22, 1986.

BACKGROUND OF THE INVENTION

1. Field of the Invention

The invention relates to a mounting assembly for an exhaust gas catalyst, including a metallic catalyst carrier body and a tubular jacket in which the catalyst carrier body is embedded.

2. Description of the Related Art

Metallic exhaust gas catalyst carrier bodies are known, for instance, from German Published, Non-Prosecuted Applications DE-OS 29 24 592 and DE-OS 33 12 944, the latter being in a more developed form. Such exhaust gas catalyst carrier bodies are coated with a catalyst material which causes the decontamination of exhaust gases. In the operating state, the catalyst carrier bodies are subjected over long periods of time to high temperatures and to alternating stresses. In addition, they must be made of high-temperature resistant steel alloys which are only slightly corrosion-prone.

During the installation of such catalyst carrier bodies in the exhaust gas systems of motor vehicles, the mounting of the bodies presents a particular problem The catalyst carrier bodies must be installed in a strong housing, such as a tubular jacket and furthermore they have to be thermally insulated. Problems arise in this connection, since the carrier bodies are subjected to expansion particularly in the longitudinal direction, at high temperatures and with increasing operating times.

If this expansion is impeded, such as by firm connections with a tubular jacket in more than one zone along the axial length, this leads to a progressive destruction of the jacket zone of the carrier body until it separates from the jacket. In addition, the otherwise good start-up behavior of a catalyst with a metallic carrier body is deteriorated if the thick tubular jacket must first be heated up concurrently during the starting phase.

SUMMARY OF THE INVENTION

It is accordingly an object of the invention to provide a mounting assembly for an exhaust gas catalyst, which overcomes the hereinafore-mentioned disadvantages of the heretofore-known devices of this general type and which provides the longest possible service life of the carrier body, but can nevertheless be produced cost-effectively and simply.

With the foregoing and other objects in view there is provided, in accordance with the invention, a mounting assembly for an exhaust gas catalyst, comprising a metallic exhaust gas catalyst carrier body, a tubular jacket in which said catalyst carrier body is disposed, and means for fastening said catalyst carrier body to said tubular jacket while permitting lengthwise expansion of said catalyst carrier body, said fastening means including beads encircling at least part of said catalyst carrier body and corresponding formations formed in said tubular jacket into which said beads protrude in the form of slots and keys, said catalyst carrier body and said beads being disposed at axial and radial distances from said tubular jacket and said formations.

In accordance with another feature of the invention, the axial and radial distances are several mm.

Embedding a catalyst carrier body in a tubular jacket according to the invention, without decisively impeding its longitudinal expansion, reduces the mechanical stress during its service life and during individual operating cycles. In connection with this measure a substantial thermal insulation between the catalyst carrier body and the tubular jacket can be achieved as a further or possibly even a separate advantage.

Therefore, in accordance with a further feature of the invention, the fastening means maintains a spacing between said tubular jacket and said catalyst carrier body, and there is provided a high-temperature resistant heat insulating material at least partially filling said space.

In accordance with a concomitant feature of the invention, the high-temperature resistant thermal insulating material is a ceramic fiber mat. Ceramic fiber mats used in some mountings for ceramic catalyst carrier bodies, are suitable.

The lowering of the thermal conductivity of bridges disposed between these two parts, or even better, the elimination of such firm metallic bridges, quickens the heating of the catalyst carrier body at the start of the operation, since less heat is transferred to the thick jacket. Furthermore, the overall operating temperatures of the jacket are lower, for which reason external thermal insulation can be reduced or omitted altogether.

Other features which are considered as characteristic for the invention are set forth in the appended claims.

Although the invention is illustrated and described herein as embodied in a mounting for a metallic exhaust gas catalyst carrier body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The Figure is a fragmentary, diagrammatic, longitudinal-sectional and partly broken-away view of a mounting of an exhaust catalyst carrier body according to the invention.

DESCRIPTION OF THE PREFERRED EMBODIMENTS

Referring now to the single figure of the drawing in detail, there is seen a metallic exhaust gas catalyst carrier body 1 in a tubular jacket 2. Exhaust gas is transported to the catalyst carrier body 1 through an inlet or intake cone 3 and flows through numerous canals in the catalyst carrier body. The device is constructed entirely without metallic thermal bridges between the tubular jacket 2 and the catalyst carrier body 1. The catalyst carrier body 1 has beads *4a*, *4b* at two or more points along the axial length thereof which extend over parts or over the entirety of the periphery thereof The tubular jacket 2 has corresponding formations *5a*, *5b* in which the beads *4a*, *4b* are engaged, like a slot and key.

However, the formations 5*a*, 5*b* are so wide and long that a space 8 of several millimeters remains everywhere between the catalyst carrier body 1 or the beads 4*a*, 4*b* and the tubular jacket 2 or the formations 5*a*, 5*b*. The space 8 is tightly filled with a thermally insulating material, preferably a ceramic fiber mat, so that the catalyst carrier body 1 can only very slightly change its position In order to protect the insulating material in the space 8, a protective ring 7 can be provided on the inlet side of the catalyst carrier body, such as in a joint 6 between an inlet cone 3 and the tubular jacket 2.

Catalyst carrier bodies mounted in accordance with the invention are suitable for installation near the engine as well as for insulation underneath the bottom tray or floor of motor vehicles.

We claim:

1. Mounting assembly for an exhaust gas catalyst, comprising a metallic exhaust gas catalyst carrier body having at least two beads being mutually spaced apart in axial direction of said catalyst carrier body, each of said beads encircling at least part of said catalyst carrier body, a tubular jacket in which said catalyst carrier body is held while permitting lengthwise expansion of said catalyst carrier body, formations formed in said tubular jacket into which said beads protrude in the form of slots and keys, said catalyst carrier body with said beads being disposed at axial and radial distances from said tubular jacket and said formations defining a spacing therebetween, and thermal insulating material at least partially filling said spacing.

2. Mounting assembly according to claim 1, wherein said axial and radial distances are several mm.

3. Mounting assembly according to claim 1, wherein said thermal insulating material is high-temperature resistant and completely and tightly fills said spacing.

4. Mounting assembly according to claim 3, wherein said high-temperature resistant thermal insulating material is a ceramic fiber mat.

* * * * *